US011738983B2

(12) United States Patent
Clüsserath

(10) Patent No.: US 11,738,983 B2
(45) Date of Patent: Aug. 29, 2023

(54) BOTTLE FILLING ARRANGEMENT FOR FILLING BOTTLES AND SIMILAR CONTAINERS, SUCH AS GLASS BOTTLES, WITH A BEVERAGE, AND A METHOD OF OPERATING A BOTTLE FILLING ARRANGEMENT

(71) Applicant: KHS GMBH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 66 days.

(21) Appl. No.: 17/500,010

(22) Filed: Oct. 13, 2021

(65) Prior Publication Data

US 2022/0024747 A1 Jan. 27, 2022

Related U.S. Application Data

(63) Continuation-in-part of application No. PCT/DE2020/100215, filed on Mar. 18, 2020.

(30) Foreign Application Priority Data

Apr. 16, 2019 (DE) ..... 102019110012.7

(51) Int. Cl.
*B67C 7/00* (2006.01)
*B05B 12/02* (2006.01)

(52) U.S. Cl.
CPC ..... *B67C 7/004* (2013.01); *B05B 12/02* (2013.01); *B67C 2007/006* (2013.01)

(58) Field of Classification Search
CPC .... B67C 2007/006; B67C 7/004; B67C 3/001
USPC ..... 141/90
See application file for complete search history.

(56) References Cited

U.S. PATENT DOCUMENTS

| | | | | |
|---|---|---|---|---|
| 3,524,483 | A * | 8/1970 | Smith | B67C 3/005 141/90 |
| 6,079,460 | A * | 6/2000 | Ballan | B67C 3/222 141/54 |
| 6,267,157 | B1 * | 7/2001 | Gruson | B67C 3/001 141/90 |
| 2013/0284309 | A1 * | 10/2013 | Graff | B67C 3/005 141/1 |

FOREIGN PATENT DOCUMENTS

| | | |
|---|---|---|
| DE | 2739742 | 3/1979 |
| DE | 4331745 | 3/1995 |
| DE | 102011008878 | 7/2012 |
| DE | 102014103504 | 9/2015 |
| EP | 0615947 | 9/1994 |

* cited by examiner

*Primary Examiner* — Jason K Niesz
(74) *Attorney, Agent, or Firm* — Laurence A. Greenberg; Werner H. Stemer; Ralph E. Locher

(57) ABSTRACT

A bottle filling arrangement for filling bottles and similar containers, such as glass bottles, with a beverage, and a method of operating a bottle filling arrangement.

20 Claims, 3 Drawing Sheets

Fig. 2
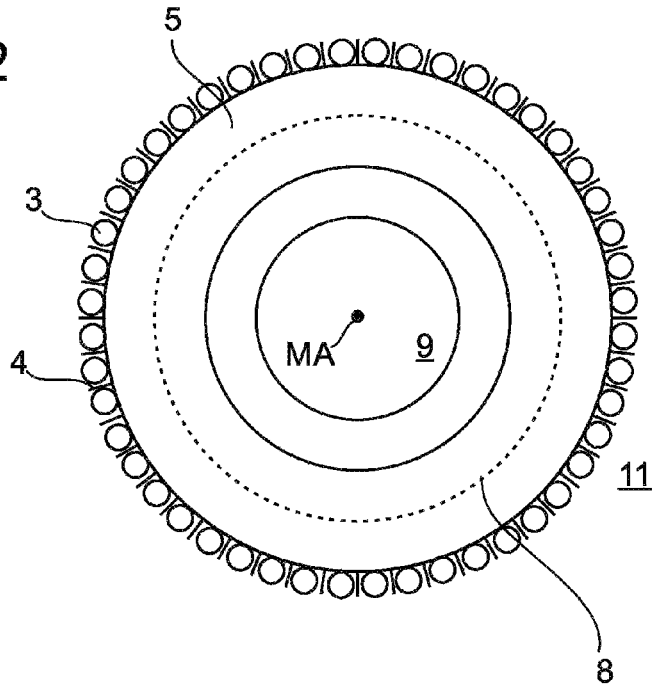
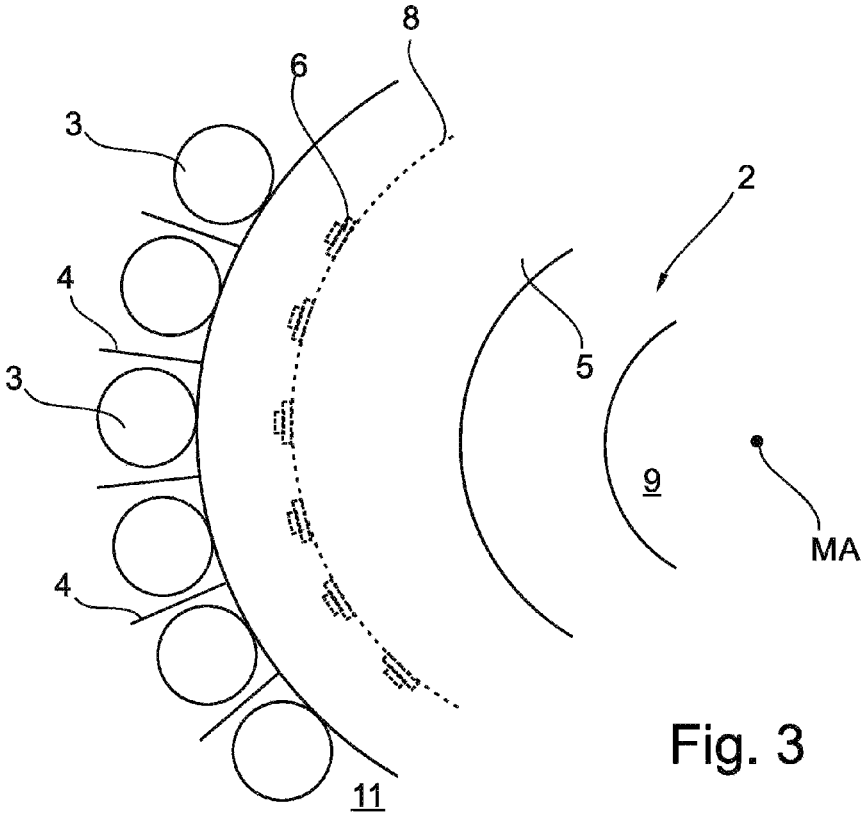
Fig. 3

BOTTLE FILLING ARRANGEMENT FOR FILLING BOTTLES AND SIMILAR CONTAINERS, SUCH AS GLASS BOTTLES, WITH A BEVERAGE, AND A METHOD OF OPERATING A BOTTLE FILLING ARRANGEMENT

CROSS-REFERENCE TO RELATED APPLICATIONS

The present application is a Continuation-in-Part of International Patent Application No. PCT/DE2020/100215, filed Mar. 18, 2020, which claims the benefit of Federal Republic of Germany Patent Application No. DE102019110012.7, filed Apr. 16, 2019, each of which is incorporated by reference herein in its entirety.

BACKGROUND INFORMATION

1. Technical Field

The present application relates to a bottle filling arrangement for filling bottles and similar containers, such as glass bottles, with a beverage, and a method of operating a bottle filling arrangement.

Beverage bottle filling machines, or simply filling machines, are used in the beverage bottle filling or bottling industry to fill bottles with a liquid beverage. Such machines can be of a rotary or linear design. Rotary beverage bottle filling machines include a rotary carousel or rotor or similar structure that has a plurality of individual beverage bottle filling devices or beverage bottle filling stations mounted or positioned on the perimeter or periphery thereof. In operation, an individual beverage bottle is received or picked up from a bottle or container handling device or machine, such as another bottle treatment machine or a container transport or conveyor, which can be either of a rotary or linear design, and held at a corresponding individual filling device or station. While the rotary carousel rotates, each individual filling device or filling station dispenses a beverage, such as soft drinks and sodas, wine, beer, fruit juices, water, or other beverages, or another liquid product. Each individual filling device is usually designed to fill one beverage bottle or similar container at a time. Upon completion of filling, the beverage bottle or container is released or transferred to yet another bottle or container handling device or machine, such as another bottle treatment machine or transport device. The filling devices are therefore designed to fully dispense a predetermined or desired amount or volume of product into the beverage bottles or containers before the beverage bottles or containers reach the exit or transfer position out from the filling machine. The beverage bottle filling machine can also be of a linear design, wherein beverage bottles are moved to one or more filling positions along a straight or linear path.

Such filling machines are usually part of a filling or bottling plant, wherein the filling machine operates in conjunction with a number of other beverage bottle or container handling machines, such as a closing machine for placing caps or closures on filled containers, a container manufacturing machine for making or forming containers to be filled, and a container packaging machine for packaging individual containers for shipment and sale to consumers. Such plants are designed to operate as quickly and continuously as possible, and any interruptions in operation result in a loss of productivity and an increase in operating costs, especially since such plants can process large numbers of containers, such as, for example, anywhere from ten to seventy thousand containers per hour or possibly more.

The present application therefore relates to container handling machines in the beverage industry, such as container handling machines with capacities of more than one thousand containers per hour, as well as container handling machines with a capacity of more than ten thousand containers per hour. The present application also relates to container handling machines which are configured and arranged as what are referred to as filling machines or fillers for the filling of containers with liquid filling contents, such as beverages, or possibly other products, such as viscous food products, medicines, or health and beauty products.

Such filling machines of the type referred to heretofore, namely apparatuses for filling, are provided with a plurality of handling stations or handling positions, which can also be understood as filling stations or filling points or filling stations. Provided at each filling position of the filling machine is a filling element of filling device, with a filling valve or liquid valve, which have a dispensing opening through which the liquid filling product is dispensed into the container. For this purpose, in general, at each filling position a container carrier is provided, for example with a container plate, by which the container that is to be filled is lifted by a vertically oriented lifting movement toward the filling element, and is guided to the filling element and pressed against it. As an alternative, the containers can also be gripped in the neck region, and in this way pressed against the filling device. For example, the dispensing of the filling product into the containers also can take place under pressure in a process often referred to as "pressure filling," in which the containers to be filled are pre-tensioned or pre-stressed, that is, they are subjected to an initial or pre-tensioning pressure before the dispensing of the filling product. In other words, the interior of the container or bottle is pressurized to an initial internal pressure prior to filling with a liquid material, such as a beverage.

When working with and filling containers made of glass, such as glass bottles, it is quite common to have repeated glass breakages during the filling process. For example, during the pre-tensioning of the container with a tensioning gas, or during the filling of the container with a filling product, or at any time up until the relaxation or reduction of pressure, a glass container may shatter. When the bottles break, large broken pieces of glass and shards are common, but much smaller glass shards and glass splinters can also result, which represent a high risk of contamination of the liquid product. Such contamination should ideally be avoided to the greatest degree possible in the foodstuffs sector when filling beverages. In this context, it is generally known that shards and splinters which pass into the containers incur many negative consequences. Quite apart from the risk to the health of the consumer, shards in the container can lead, for example, to recall actions, loss of prestige, and even to the loss of market shares. Minimizing such contamination to at least a desired level protects both consumers and the manufacturers.

2. Background Art

This section is for informational purposes only and does not necessarily admit that any publications discussed or referred to herein, if any, are prior art.

In order to address the issue of contamination due to glass breakage, there have been many efforts to provide filling machines with appropriate preventive measures to avoid shards and splinters resulting from shattering or splintering glass containers entering into the containers which are to be filled, and therefore reaching the consumer. What is sometimes known in the bottling industry as "shard safety" is therefore a very important requirement for filling machines of the type referred to heretofore, such as those machines that perform counter-pressure filling and/or hot filling.

In some filling machines, in order to enhance the safety of the filling machines, provision can be made for flushing devices or spray devices, with the aid of which glass breakage residues can be removed. For example, in one apparatus for the filling of containers that is configured as a filler carousel, a flushing device is provided in order to remove glass breakage residues incurred at a filling location, specifically shards from bottle bases, from the container plates of the container carriers. The flushing device, which includes a flushing tube and a flushing nozzle, can be configured such as to rotate together with the filler carousel. In this situation, the flushing nozzles are arranged, in relation to the axis of rotation of the filler carousel, radially outside the container carrier of the filling locations and on a level beneath the container plate. The flushing nozzles are configured in such a way that a flushing medium jet emerging from a flushing nozzle is directed inwards towards the rotation axis, and is aimed so as to pass through beneath the container plate. An additional deflection device is provided at the container carrier, which deflection device deflects the flushing jet such that the flushing medium jet sprays over the surface of the container plate, and container shards are flushed away outwards.

In another type of rotary filling machine, there is a ring tank secured at the rotor. A free space, which is open in both downwards and upwards directions, is formed between the ring tank and the rotor and is delimited inwards by a cylindrical protection wall. In this rotary filling machine, a pipeline is provided above the free space, with a plurality of spray nozzles which spray the ring-shaped free space and the adjacent protection wall. In this situation, a spray jet emitted from the spray nozzles is oriented such as to come vertically downwards and coming from the outside inwards, wherein impurities, such as glass splinters, which are carried along with the spray medium, can flow out unhindered over or through the free space. If required, the pipe line can be subjected, manually or automatically, to a fluid under pressure in order to carry out a spray procedure for one or more revolutions of the rotor. However, one disadvantage of this design is that it is not possible for specific individual filling positions and associated filling elements to be thoroughly cleaned individually and at will, but at the same time as thoroughly as possible.

In another filling machine, a plurality of filling positions are arranged distributed over the circumference of a rotor, each filling position having a filling element and a container carrier. At each filling position, a spray tube standing perpendicular, i.e., vertically, is provided at each filling position and is secured to an associated lifting cylinder between the container carrier and a flange on the upper side. A plurality of spray nozzles are formed in the spray pipe and are directed essentially horizontally such that the spray jet is directed outwards away from the rotation axis of the rotor. The spray pipe is also in connection with a spray nozzle, which can discharge a spray jet directed vertically from below upwards. The delivery of the spray medium to the spray pipe is released by a separate, mechanically-actuatable valve. The actuation of this valve is put into effect by the lifting cylinder, and specifically only when the lifting cylinder carries out a lifting movement that is greater than the normal lifting movement necessary for pressing a container against the filling valve. In greater detail, when pressing a container against the filling valve, the lifting cylinder is specifically limited in its lifting movement by this container. By way of example, if the container being pressed were now to shatter, the lifting cylinder would continue the lifting movement, and therefore actuate the separate valve. In this situation, a spray procedure can only be carried out at the filling position which is directly concerned, and specifically only directly at the occurrence of a glass breakage event. Adjacent filling positions involved in the incident cannot be cleaned, with the result that the risk of shards or splinters passing into the containers due to splinters adhering to such adjacent filling positions still pertains.

SUMMARY

At least one object of at least one possible exemplary embodiment disclosed herein is to provide an apparatus for the filling of containers with liquid contents which allows for an individual removal, suitable to the requirements, of impurities and glass breakage residues, and therefore allows for a method of operation with optimal safety and minimized contamination. The object could be addressed by an apparatus and/or a method in accordance with at least one possible exemplary embodiment disclosed herein.

The present application discloses at least one possible exemplary embodiment of an apparatus for the filling of containers with liquid contents. The apparatus comprises a rotor, which is driven such as to rotate about a vertical machine axis, with a plurality of filling elements arranged at similar intervals over the circumference of the rotor. The filling elements are connected to a filling product container for the liquid filling product. A plurality of spray nozzles are provided, which can dispense a spray medium and are moved together so as to circulate with the rotor. In this situation, at least one spray nozzle unit is fixed as assigned to each filling element, moved with it such as to circulate, and facing towards a nozzle opening of the spay nozzle units in the respective filling element assigned to it. The spray nozzle units can be controlled individually, wherein, for this purpose, the spray nozzle units are equipped with suitable controllable valves, and, further, a control unit is provided which is in communicating connection with the spray nozzle units. In other words, each filling element has a corresponding spray nozzle unit or units mounted adjacent to it on a rotary portion of the filling apparatus, such that when the rotary portion rotates, the filling elements and their spray nozzles rotate together in a circulating motion, and thus the spray nozzles are always directed toward their corresponding filling elements.

In the understanding of at least one possible exemplary embodiment, an apparatus for the filling of containers with liquid contents is to be understood as a rotating filling machine or as a circulating filling machine, and in the present situation is also designated as a filling machine, a filler, or a filler carousel. A filling machine comprises in this situation a plurality of filling elements, which together with a plurality of container carriers, likewise circulating with the rotor, form a plurality of filling places or filling positions. It is possible, for example, for flat separation plates to be located between the individual filling positions or between the individual filling elements, which are oriented radially in such a way that at each filling position for each filling element, in each case, two separation plates form a side delimitation for a type of chamber, wherein each separation plate faces adjacent filling elements with its two opposing flat sides. In other words, the flat plates extend essentially or substantially radially with respect to the rotational axis of the rotor, with at least one flat plate between each of the filling elements, to thereby separate the filling elements from one another and form individual chambers to contain the results of bottle breakages, e.g., glass splinters, shards, spilled liquid, to minimize contamination of more than one filling element.

With the device according to at least one possible exemplary embodiment, each filling element can be sprayed, regardless of a rotational position of the rotor, since at least one circulating spray nozzle unit is permanently and individually assigned to each filling element and moves with it. The fact that a nozzle opening of the spray nozzle units faces towards the respective assigned filling element can, in the understanding of at least one possible exemplary embodiment, also be understood to mean that the nozzle opening is configured and aligned in such a way that a spray jet or spray media jet emerging from this nozzle openings of the jet nozzle units impacts at least onto one area or part area of the assigned filling element, as a result of which at least this area or part area is sprayed and cleaned. A spray nozzle carrying the nozzle opening or a spray nozzle body carrying the nozzle opening can be arranged at or secured to the rotor, or also to the respective filling element itself.

The phrase "individually controllable spray nozzle units" is to be understood in the meaning of at least one possible exemplary embodiment such that the spray nozzle units can be or are individually controlled, and also in such a way that the spray nozzle units can be switched in a controlled manner by the control arrangement, which can control the switching such that the corresponding controllable valves are opened and also closed again. This is also understood in the present situation to be the activation of the spray nozzle units. Spraying procedures can therefore be initiated and carried out in a controlled manner. The spray nozzle units can be switched at will in this situation, i.e., they can be activated individually, several simultaneously, or in groups.

With the filling machine according to at least one possible exemplary embodiment, and due to the possibility of individual and selective control and switching capability of the spray nozzle units, a spray procedure can be actuated or initiated and carried out individually for each filling position. In accordance with at least one possible exemplary embodiment, the spray nozzle units can be controlled and switched by this control and switching arrangement individually as well as in groups. For example, in the event of a glass breakage event occurring at a specifically affected critical filling position, it is then possible not only for this filling position to be sprayed and cleaned quite specifically, but, in addition to this, for example as a precaution, the filling elements of the two immediately adjacent filling positions, and other adjacent filling positions if required, such as filling elements of upstream and/or downstream filling positions, can also be sprayed and cleaned. In other words, if a glass breakage occurs at one filling element or filling position, a cleaning procedure can be performed at the affected filling position, but also at adjacent filling positions, as it is not uncommon for glass breakages to contaminate more than just the filling position where the breakage occurred because glass splinters and shards can be propelled by the force of the breakage to adjacent filling positions.

The switching or switching on of the spray nozzle units can take place in this situation independently of whether a container is present at the filling position, such as in a sealing position with the filling element, or whether the filling position is present without containers, i.e., is empty. As a result, the "shard safety" of the apparatus is perceptibly increased, since the removal of glass splinters can take place both at a critical filling position with a glass breakage incident as well as simultaneously at filling positions which may not be directly or immediately affected but are in spatial proximity, and therefore are in a risk area.

As a result of this configuration, the use of a suitable control system allows for one or more spraying procedures to be activated, for each filling position and for each filling element respectively, or also for a group of filling positions or filling elements, and at any desired point of time. The solution according to at least one possible exemplary embodiment not only provides the possibility of removing shards and splinters at corresponding filling positions, but it is also possible for sticky product residues to be removed from filling pipes, probes, and return gas pipes, as well as from other components in the surrounding area of filling elements. Since it is also known that shard fragments can adhere to these sticky product residues, such adherence can likewise be avoided or minimized to thereby minimize contamination.

For an additional increase in shard safety, further and additional optimization procedures can be adopted, which can be combined with the solution according to at least one possible exemplary embodiment. For example, the separation plates already referred to, located between the filling elements, can serve as a splinter protection. It is also possible to make use of additional stationary filling pipe jets directed from the outside onto the filling pipes, possibly located between inlet and outlet stars.

According to at least one possible exemplary embodiment, the spray nozzle units are arranged radially internally in relation to the machine axis and relative to the respective assigned filling elements, wherein the nozzle opening of each spray nozzle unit points towards an inner side of the assigned filling element, which inner side is facing in the direction of the vertical machine axis. A spray jet emitted from the spray nozzle unit is thereby directed outwards away from the vertical machine axis and towards the inner side of the assigned filling element.

As a result of this design, it is also possible for the spray medium to reach portions of the machine which are located on the inner sides of the filling elements that cannot be reached, or at least cannot be reached effectively, with spray medium sprayed some types of external spray devices currently available in the bottling industry. Such external spray devices are often arranged in a fixed position outside of the filling elements and do not circulate with the filling elements, and therefore the inner sides of the filling elements and other such portions of the filling machine are located in so-called "shaded" areas that cannot be effectively cleaned or treated by such external spray devices. Even if such spray jets coming "from the outside" exhibit considerable strength, they do not impact on the inner sides of the filling elements, which lie in the spray- or jet-shaded areas.

According to at least one possible exemplary embodiment, it is therefore possible for the cleaning of the filling elements also and to promote or optimize cleaning of the inner sides of the filling elements.

Adhering splinters and/or product residues, which are often present on the inner sides of the filling elements due to the spray- or jet-shaded areas of some conventional spray jet devices currently available, therefore can be successfully and effectively removed. Such a design also contributes to product safety. Accordingly, the adhering of splinters or shard residues to components of the filling element can be prevented or at least minimized to an acceptable level, as a result of which, for example, the undesirable ingress of shard residues or splinters into one of the following bottles can be counteracted or minimized.

The spray procedure according to at least one possible exemplary embodiment can be used in filling processes involving fruit juices or similar liquids. To further explain, during the filling of such products as fruit juices or similar liquids, sticky residues may remain at the filling pipe or at the filling level probe, or at the return gas pipe, etc., to which even the very smallest shard fragments can remain hanging or adhering. During the next filling procedures, these shards or similar contaminants come in direct contact with the filling product, and consequently become detached during the filling procedure and fall into the bottle. Such "splinter conveying," which can often occur when splinters or shards stick to the inner side of the filling element, can be avoided or at least minimized to an acceptable level.

According to another possible exemplary embodiment, each filling element is formed from a plurality of filling element components, including at least one filling pipe. The at least one spray nozzle unit assigned to the filling element is provided at the rotor in such a way that the nozzle opening of the at least one jet nozzle unit is arranged with at least one section of the filling pipe at the same vertical height, as a result of which the filling pipe, for example with long-pipe fillers, can be cleaned and freed of splinters. The filling elements comprise not only the filling pipe but also other components, such as a filling level probe, a return gas pipe, a centering tulip element or sealing ring element, and a filling valve with a dispensing opening. The operation of the filling elements or the dispensing of the liquid filling product carried out by the filling elements into the containers are controlled by a central electronic control device.

In accordance with at least one possible exemplary embodiment, the filling product reservoir is formed by a ring tank arranged at the rotor and rotating with the rotor, which ring tank also carries or supports the filling elements. In accordance with at least one possible exemplary embodiment, the filling elements extend along a filling element axis and are carried circumferentially at an outer circumference of the ring tank, such as by a carrier section provided on the upper side at each filling element, by which the filling elements are secured to the ring tank. A filling section or dispensing section of the filling element, pointing freely downwards in the vertical direction, is connected along the filling element axis to the respective carrying section and underneath it. The at least one spray nozzle unit assigned to the filling element is provided at the rotor in such a way that the nozzle opening of the at least one spray nozzle unit lies at the same height as a lower free end of the filling element.

As an alternative, the filling product reservoir can be formed by a stationary central reservoir and a pipe ring tank which rotates with it, wherein the filling elements are not arranged directly at the pipe ring tank and carried by it, but at the rotor, in particular at a rotor part which carries the filling elements.

According to at least one possible exemplary embodiment, provided in a free interior space of the rotor is at least one ring line, secured to a rotor inner side and circulating together with the rotor, for supplying the spray nozzle units with spray medium, wherein the spray nozzle units are connected to the ring line by suitable connections. For delivering the spray medium to the ring line, a pressure line with a rotary distributor is provided. A liquid medium as a spray medium, for example subjected to pressure, such as hot or cold water, can be conveyed by this pressure line with the rotary distributor into the area in the interior of the filling machine or the filler carousel, and then passed to the ring line. The pressure line can be, for example, a pressurized water line. As the pressurized medium, namely as the spray medium, it is also possible to use rinsing or cleaning liquids.

In principle, the spray medium can be water in a cold or hot state. It is also possible for cleaning and disinfection materials to be added to the spray medium. The spraying can also be carried out in several spraying stages or spraying steps, for example first with a spray medium with cleaning and disinfection additives, and then, in a second step, with drinking water. For this purpose several ring lines can be provided, for example, by which the individual different spray media can be conveyed, possibly in a controlled manner.

In accordance with at least one possible exemplary embodiment, a protection wall is provided, circulating concentrically about the vertical machine axis, which is arranged radially inside the filling elements and which delimits the free interior of the rotor against an outside area, wherein the filling elements are arranged in the outer area. In this design, the possibility can be avoided or minimized that glass splinters from broken bottles can pass into the interior of the rotor, and therefore onto the inner side of the filling machine.

In the at least one possible exemplary embodiment with a protection wall, the spray nozzle units are provided in the area of the protection wall, wherein the nozzle openings of the spray nozzle units are arranged on an outer side of the protection wall facing towards the outer area. In this situation, for example, a respective nozzle body of the spray nozzle units is received in cut-out openings provided in the protection wall, and projects through the protection wall, wherein the nozzle body extends at least from an inner side of the protection wall, facing towards the interior, as far as into the outer area. In addition, it is possible, for example, for the control unit and other sensitive constituent parts or components of the spray nozzle units to be accommodated in the interior of the rotor, protected from glass shards and from liquids.

In at least one possible exemplary embodiment, the spray nozzle units can also be provided directly or indirectly at the filling elements, such as by being arranged and secured on them. It is also possible in this situation for the spray medium delivery to take place through the filling elements, such as through constituent parts or components of the filling elements.

In at least one possible exemplary embodiment, two or more spray nozzle units are arranged secured to each filling element, wherein the spray nozzle units assigned to a particular filling element can be controlled individually and/or jointly in predetermined groups. For example, in this situation each spray nozzle unit assigned to a filling element can be actuated by a respective separately controllable valve. As an alternative, if several spray nozzle units are assigned to one filling element, then it is also possible for all the spray nozzle elements assigned to the filling element to be actuated by one common valve.

In accordance with at least one possible exemplary embodiment, the plurality of spray nozzle units are arranged above one another in a vertical direction, wherein, for example, the spray jets emitted by the plurality of spray jet units wet different sections of the filling pipe, following one another along the filling element axis, or spray them with full effect. Likewise, due to the arrangement of the plurality of spray nozzle units per filling element, the effect can be achieved that the filling level probe and/or the return gas pipe and/or the outlet area of the filling element surrounding the dispensing opening can at least be wetted, or more fully and effectively sprayed, and that it is also possible for spraying to be carried out between the separation plates provided between the filling elements.

The controllable valve can be a pneumatically controlled media valve. As an alternative, it is also possible to use other suitable controllable valves, such as solenoid valves or electrically controlled valves.

In accordance with at least one possible exemplary embodiment, each filling element is equipped with a pressure sensor for measuring the pressure prevailing in the container. The pressure sensor can be in communicating connection with the control unit for the controlling of the valves of the spray nozzle units. This pressure sensor permanently or completely measures the pressure prevailing in the container which is to be filled, wherein the corresponding measurement data is transferred to the central electronic control device, which controls the filling elements or the dispensing by the filling elements of the liquid filling product into the containers. The measurement data is evaluated accordingly by an evaluation unit and drawn on for control processes. The central electronic control device can be, for example, a central control computer.

The control unit for controlling the valves of the spray nozzle units can be a separate unit communicating with the central electronic control device, or can be a part of the central electronic control device, such as an integral component part of it. In this situation, the pressure sensor is in direct communicating contact with the control unit, or indirectly by way of the central electronic control device. The measurement data and the evaluated measurement data is drawn on by the control unit in order to generate corresponding control signals or output signals, by which, in turn, the controllable valves of the spray nozzle units are switched.

If, for example, such a pressure sensor detects the breaking of a bottle at a specific filling position by the detection of a sudden pressure drop, then at least the filling position affected can be immediately sprayed or flushed out, such as from the inside outwards, for which purpose the corresponding controllable valve to the ring line is opened. However, it is also possible, simultaneously, in addition to spraying the filling element of the filling position affected by the bottle breakage, several other filling elements located upstream and/or downstream of the affected filling position, as seen in the direction of rotation of the filling machine, can be sprayed out by the corresponding simultaneous actuation of their corresponding valves, following directly or at intervals.

According to at least one possible exemplary embodiment, in addition to the spray nozzle units arranged radially inside the filling elements, it is also possible for further spray nozzle units to be provided, which are arranged radially outside the filling elements, and of which the spray jet is directed inwards in the direction onto the vertical machine axis. It is likewise conceivable, in addition to the spray nozzle units arranged radially inside the filling elements, for a fixed-position spray device with several spray nozzle units to be provided, of which the spray jets are directed inwards, in the direction onto the vertical machine axis. The fixed-position spray device can also be provided if the filling machine is provided with spray nozzle units arranged radially inside and radially outside the filling elements and rotating with them. As a result, it is possible for a simultaneous spraying to take place from the outside as well as from the inside, as a result of which a particularly complete and reliable removal of glass shards or glass splinters is achieved.

The present application also discloses a method for the filling of containers with a liquid filling product using an apparatus for the filling of containers. The apparatus comprises in this case a rotor which can be driven such as to rotate about a vertical machine axis, with a plurality of filling elements arranged distributed over the circumference of the rotor, which are connected to a filling product reservoir for the liquid filling product. With the apparatus, there is additionally arranged secured to each filling element at least one controllable spray nozzle unit which moves in rotation together with the rotor. In accordance with at least one possible exemplary embodiment, if the need arises, a spraying procedure can be initiated and carried out for spraying at least one section of at least one specific filling element, wherein, for this purpose, at least the spray nozzle unit assigned to this filling element is individually activated by a control unit provided, wherein a controllable valve provided of the spray nozzle unit is opened, and, as a result of this, a spray jet emitted by the spray nozzle unit is directed onto at least one section of the filling element.

In accordance with at least one possible exemplary embodiment, a spray procedure for the spraying of at least one section of at least one specific filling element is actuated and carried out as a reaction to a glass breakage incident in a corresponding filling position, wherein a pressure sensor is provided at the filling element for measuring the internal pressure of a container and is configured to measure a sudden pressure drop incurred by the glass breakage incident, and wherein, as a dependency of corresponding measurement and evaluation data of such a measured pressure drop, the spray nozzle unit assigned to the filling element at the corresponding filling position is actuated by the control unit in order to initiate a spray procedure.

In accordance with at least one possible exemplary embodiment, in reaction to a glass breakage incident at a corresponding filling position, several spray nozzle units are actuated in order to initiate a spray procedure at several of the filling positions located upstream and/or downstream of the corresponding filling position.

Although some aspects have been described in connection with a specific apparatus, it is understood that these aspects also represent a description of the corresponding method, such that a block element or a structural element of an apparatus is also to be understood as a corresponding method step or as a feature of a method step. By analogy with this, aspects which have been described in connection with a method step or as a method step also represent a description of a corresponding block or detail or feature of a corresponding apparatus. Some or all of the method steps can be carried out by a hardware apparatus, or with the use of a hardware apparatus, such as, for example, a microprocessor, a programmable computer or an electronic circuit. With some exemplary embodiments it is possible for some or many of the method steps to be carried out by such an apparatus.

BRIEF DESCRIPTION OF THE DRAWINGS

FIG. 2 shows a schematic representation of the filling arrangement as viewed from above;

FIG. 3 shows an enlarged view of a section of the filling arrangement shown in FIG. 2;

DETAILED DESCRIPTION

Figure 1:
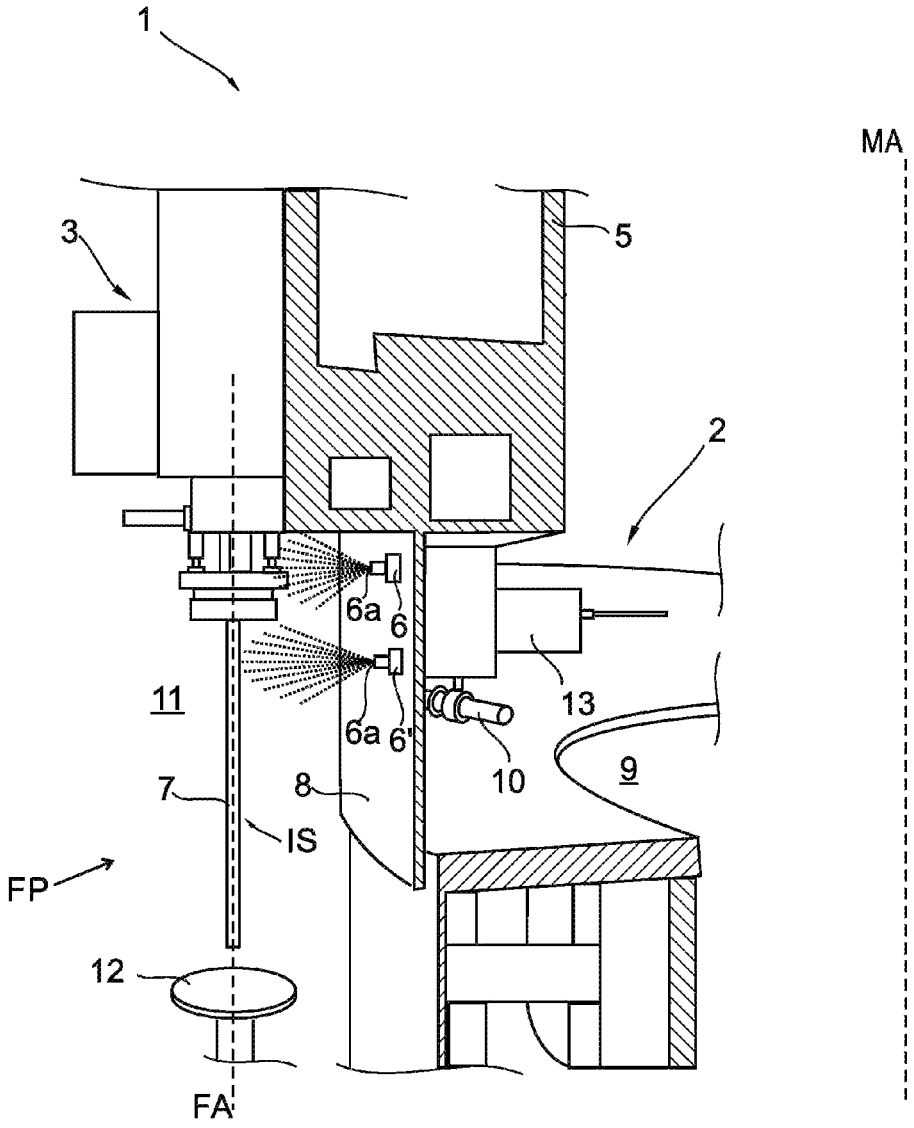
FIG. 1 shows a cross-sectional view of the filling arrangement according to at least one possible exemplary embodiment.

FIG. 1 shows in a schematic vertical section representation a section or part area of an embodiment of an apparatus 1, configured as a circular runner machine for the filling of containers with liquid filling product.

The filling apparatus 1, which in the present case is also designated as a filling machine or circular runner filling machine, comprises a rotor 2, which can be driven or is driven such as to rotate about a vertical machine axis MA. The rotor 2 can, for example, supported in a height-adjustable manner on the upper side of a carrier, which is not explicitly shown in the figures, wherein the carrier is mounted on a fixed-position stand and can be rotated about the machine axis MA, such as by being installed on a clewing ring.

Arranged at the rotor 2, and rotating together with the rotor 2, is a filling product reservoir 5 for the liquid filling product, configured as a ring tank. According to the example represented, the ring tank 5 carries the plurality of filling elements 3 also provided and distributed over the circumference, wherein the filling elements 3 are secured at the circumference of the ring tank 5 on its outside, located radially outwards. For this purpose, the filling elements 3 are connected, for example via an upper carrier section, to the ring tank 5, such that a lower section of the filling elements 3, comprising a dispensing opening, points freely downwards. The lower section in the present case is also understood to be a filling end or filling section.

A container carrier is assigned to each filling element 3 extending along a filling element axis FA, which container carrier circulates with the filling element and can be moved in a lifting movement in the vertical direction, and which together with the filling element 3 forms a filling point or filling position FP. The container carrier comprises, in this situation, a carrier plate 12, which is arranged beneath the filling element 3, and, in this situation, is aligned concentrically to the filling element axis FA. With the filling machine 1, it is possible, for example, for 132 filling positions FP to be arranged distributed uniformly over the entire circumference of the rotor 2, wherein the sequentially numbered filling positions FP, beginning with filling position 1 to filling position 132, describe a full circle of 360 degrees. From the view from above represented in FIG. 2, the arrangement of the filling elements 3 goes in front of the ring tank 5, wherein in FIG. 2, for reasons of easier overview, only 48 filling elements 3 are represented, distributed around the ring tank 5. It is of course understood that this representation is not limiting.

Arranged between the filling elements 3 of the plurality of filling positions FP are flat separation plates 4 (not identifiable in FIG. 1, see FIGS. 2 and 3), which extend in a radial orientation and, to a certain degree, screen the individual filling positions FP against one another. For example, in this situation, the risk can also be reduced that, in the event of a glass breakage incident at a particular filling position FP, such as, for example, at filling position FP number eleven, the glass shards and splinters incurred might be transferred to the adjacent filling positions FP, such as, for example, filling positions FP numbers ten and twelve, and there might pass to the filling elements 3.

The filling elements 3 of the exemplary embodiment represented are configured as being of multiple parts, and comprise at least one filling pipe 7, extending longitudinally in the axial direction of the filling element axis FA, as well as other components, not designated in greater detail in the Figures, such as, for example, a filling level probe, return gas pipe, filling valve, or centering tulip element or sealing ring or centering bell. The filling elements 3 are controlled by means of a central control device.

Formed at the rotor 2 of the present filling machine 1 is a free interior space 9, which is located opposite an outer area 11. A delimitation of the interior space 3 and the outer area 11, in the embodiment variant of the filling machine 1 represented, is further supported by a cylindrical or curved protection wall 8, provided at the rotor 2 and circulating concentrically about the machine axis MA, which separates the free interior space 9 from the outer area 11, wherein the filling elements 3 are arranged in the outer area 11. The protection wall 8 also can prevent or minimize glass shards or splinters from bottles breaking at the filling positions FP from passing into the interior space 9 of the rotor 2, and therefore into the filling machine 1. Additionally, the protection wall 8 screens or protects constituent parts or components arranged in the interior space 9 against liquids, contaminants, and pieces of broken glass. For example, in this way sensitive constituent parts or components, such as circuits, control devices, electrical supply leads or the like, can be protected by being located in the interior space 9.

The filling machine 1 further comprises a plurality of spray nozzle units 6, 6', which can be subjected to a spray medium and circulate together with the rotor 2, for the spraying and cleaning of at least one section of the filling elements 3. At least one spray nozzle unit 6 is permanently assigned to each filling element 3, and a respective nozzle opening **6*a* of each spray nozzle unit 6, 6', faces towards the assigned filling element 3. In the example represented, two spray nozzle units 6, 6', are permanently assigned to each filling element 3, arranged above one another in a vertical direction and mounted so as to circulate together with the filling element 3, and specifically in direct spatial proximity to the filling elements 3**.

The spray nozzle units 6, 6', are arranged located radially inwards in relation to the machine axis MA and relative to the filling elements 3, such that the nozzle openings **6*a* of each spray nozzle unit 6, 6' face towards an inner side IS of the respective assigned filling elements 3, pointing in the direction of the vertical machine axis MA. A spray jet emitted by the spray nozzle unit 6, 6', in this situation, is directed away from the vertical machine axis MA outwards and towards the inner side IS of the filling end or filling section of the assigned filling element 3. In the context of this application, phrases such as "radially outwards" and "radially inwards," or terms such as "outside" and "inside" or "outer" and "inner," should be understood as referring to the relative positioning of components of the filling machine 1 as viewed from above, similar to the view in FIG. 2, with respect to the rotational machine axis MA of the filling machine 1. For example, in FIG. 2, the filling elements 3 are considered radially outside the reservoir 5** by being positioned further away from the machine axis MA, as viewed from above in a radial direction.

The spray nozzle elements 6, 6' of the example represented are provided at the rotor 2 in such a way that, of the two spray nozzle units 6, 6' provided in each case per filling element 3, one each is arranged at the same vertical height as a section of the filling pipe 7, and the other is arranged lying somewhat higher, for example, at approximately the height of the centering tulip element or of the return gas pipe. By the initiation of a spraying procedure by both of the spray nozzle units 6 assigned to a filling element 3, a corresponding filling element 3 can therefore be effectively sprayed off and cleaned, such as on several sections.

The spray nozzle units 6, 6' are arranged in such a way that the spray jets emitted by them at least wet, or possibly effectively spray off, the filling pipe 7 and/or the filling level probe and/or the return gas pipe and/or the centering tulip element and/or the dispensing opening of the filling element 3 and/or the run-out area of the filling element 3 surrounding the dispensing opening, and/or the separation plates 4 screening the filling element 3 at the sides.

In the possible embodiment variant represented, the spray nozzle units 6, 6' are provided in the area of the protection wall 8, wherein the nozzle openings 6*a* are arranged on an outer side of the protection wall 8 facing towards the outer area 11. For this purpose, for example, corresponding passage openings or cut-out openings are provided in the protection wall 8, in which a respective nozzle body of the spray nozzle units 6, 6' is received, in such a way that the nozzle body projects through the protection wall 8 and extends through it, wherein the nozzle body extends from an inner side of the protection wall 8, facing towards the interior space 9, as far as the outer area 11, where the nozzle opening 6*a* is effectively arranged.

Provided in the interior 9 of the rotor 2 is a ring line 10, secured to an inner side of the rotor and moved so as to circulate with the rotor 2, for supplying the spray nozzle units 6, 6' with spray medium. In this situation, the spray nozzle units 6, 6' are connected by suitable connection elements to the ring line 10. The ring line 10 itself is fed, for example, by way of a pressure line with a rotary distributor, not visible from the figures but in fluid connection with the ring line 10. In at least one possible exemplary embodiment, liquid medium subjected to pressure, i.e., pressurized liquid medium, such as hot or cold water or cleaning medium, is used as the spray medium, which is guided via a pressure line with a rotary distributor into the interior space 9 of the rotor 2 of the filling machine 1, and there is introduced accordingly into the ring line 10 connected to the pressure line.

The spray nozzle unit 6, 6' are individually controllable or can be switched in a controlled manner. For this purpose, a control unit 14 (not designated in FIG. 1, see FIG. 3) is provided which is in communicating connection with the spray nozzle units 6, 6', and the spray nozzle units 6, 6' are equipped with suitable controllable valves 13, which are arranged together protected in the interior space 9. The controllable valves 13 can be configured in the form of pneumatically controlled media valves, although electrically controlled valves are also possible. In this situation, each spray nozzle unit 6, 6' can be individually controlled, wherein several spray nozzle units 6, 6' can be switched simultaneously, such that a spray procedure can be initiated with several spray nozzle units 6, 6', which are provided assembled in any desired groups to suit the requirements. In the present case, this is of the same significance as the spray nozzle units 6, 6' can be switched individually and at will, as well as in groups. In other words, the spray nozzle units 6, 6' can be configured as individually-controllable units, any number of which can be activated at any time to provide individual spraying or spraying as a group, or they can be configured as groups of units that are always activated together, such as, for example, two or three or more spray nozzle units 6, 6' located at and assigned to a filling element 3, wherein the groups of spray nozzle units 6, 6' can be activated separately as needed.

Due to the spray nozzle units 6, 6' being controllable and switchable at will and independently, in the event of a glass breakage incident occurring at a filling position, such as, for example, filling position eleven, both the filling element 3 at this filling position that is affected will be sprayed and cleaned, as well as, simultaneously, for the purpose of safety, also the adjacent filling positions FP ten and twelve, and possibly additionally the filling positions FP nine and thirteen, or possibly others, are likewise sprayed and cleaned. In other words, it is possible to spray and clean not only the components of the filling position FP where the breakage actually occurred, but any number of adjacent filling positions that could possibly be contaminated by contaminants, such as glass shards or splinters or splashed liquid filling material.

The spray nozzle units 6, 6' can in this situation also be switched on at intervals. In as much as several spray nozzle units 6, 6' arranged vertically above one another are assigned to one specific filling element 3, such as in the example represented in FIG. 1, it is possible in the first instance for the uppermost spray nozzle unit 6 to be actuated in order to initiate a sequence of spray jets at a predetermined interval of time. The spray nozzle units 6' arranged beneath can, for example, likewise be actuated at intervals, but temporally offset in relation to the uppermost spray nozzle unit 6, such that the filling element 3 is thereby sprayed successively from top to bottom, possibly with several spray pulses. In other words, the timing of activation of each spray nozzle unit 6, 6' can be staggered or occur at intervals.

FIGS. 2 and 3 once again clarify the arrangement of the filling elements 3, the protection wall 8, and the spray nozzle units 6, 6' at the rotor 2, and specifically relative to one another and relative to the machine axis MA. Starting from the machine axis MA, the filling elements 3 are arranged located on the outside in the outer area 11, wherein the spray nozzle units 6, 6' (omitted in FIG. 2 for reasons of easier overview), which are provided, in accordance with the example represented, arranged in the area of the protection wall 8 and radially inside the filling elements 3. The nozzle openings 6*a* of the spray nozzle units 6, 6' face towards the inner side IS of the filling elements 3.

Figure 4:
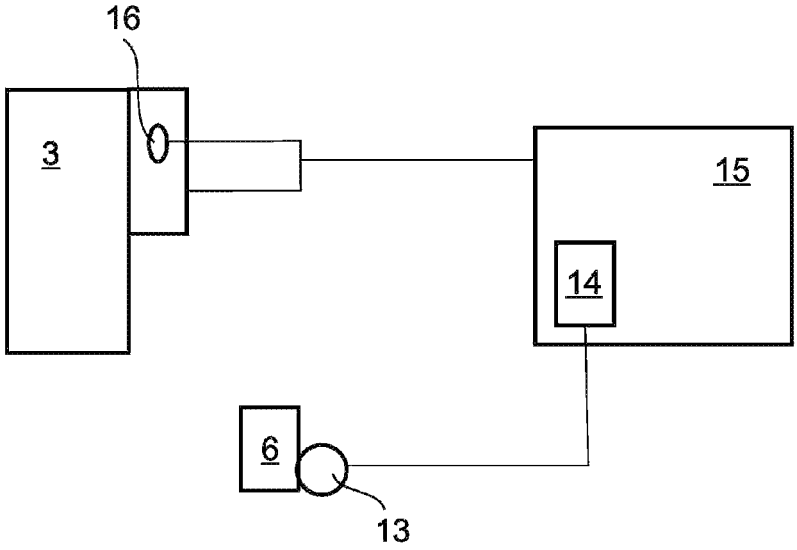
FIG. 4 shows a schematic circuit diagram for a control arrangement according to at least one possible exemplary embodiment.
Figure 5:
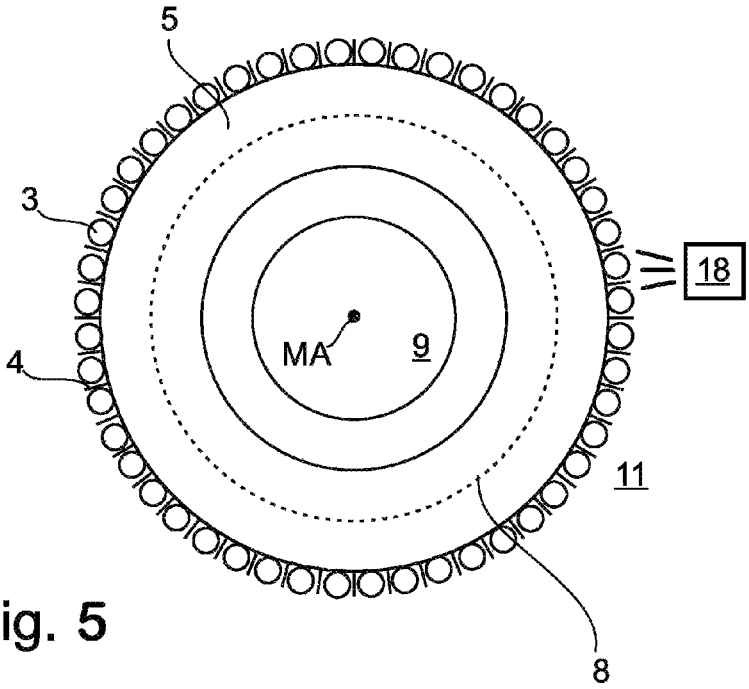
FIG. 5 shows a schematic representation of a filling arrangement as viewed from above according to at least one possible exemplary embodiment.

FIG. 4 shows a schematic circuit diagram for a control arrangement in an exemplary embodiment of the present filling machine 1, wherein, with the exemplary embodiment, each filling element 3 is additionally equipped with a pressure sensor 16 for measuring the pressure prevailing in the container. The pressure sensor 16 is in communicating connection with the control unit 14 for the controlling of the valves 13 of the spray nozzle units 6, 6', and permanently or continuously measures the pressure prevailing in the container which is to be filled. In the embodiment represented, the control unit 14 for the controlling of the valves 13 is configured as an integral part of a central electronic control device 15, at which the corresponding measurement data from the pressure sensors 16 is transferred, and which controls the filling elements 3 and, respectively, the dispensing of the liquid filling product by the filling elements 3 into the containers. Each pressure sensor 16 communicates, via this central electronic control device 15, with the control unit 14 for the controlling of the valves 13, which issues control signals for the switching of the controllable valves 13 of the spray nozzle units 6, 6', and specifically by drawing on the measurement data from the pressure sensors 16 and, respectively, on the evaluation data processed from this measurement data accordingly in an evaluation unit of the central electronic control device 15.

As soon as a pressure sensor 16 measures a sudden pressure drop at a filling position FP affected, which occurs, for example, due to a glass breakage, this measurement data is used in order immediately to switch, in a controlled manner via the control unit 14, at least the controllable valve 13 of the spray nozzle units 6, 6' assigned to the filling element 3 of the affected filling position FP, namely to open it, in order for the affected filling element 3 to be sprayed or flushed. In accordance with at least one possible exemplary embodiment, the control unit 14, it is possible for the control unit 14 to simultaneously open, in a controlled manner, at least the controllable valves 13 of the spray nozzle units 6, 6' of the filling elements 3 adjacent to the affected filling element 3.

In accordance with at least one possible exemplary embodiment, at least one stationary spray nozzle unit 18 can be placed in a fixed position in the outer area 11. The spray nozzle unit 18 is arranged radially outside the filling elements 3, that is, as viewed from the vertical machine axis MA, the spray nozzle unit 18 is further away from the vertical machine axis MA than the filling elements. The spray nozzle unit 18 does not rotate with the filling elements 3, but rather sprays from the position in which it is located to provide additional cleaning of the filling elements 3.

The following is at least a partial list of components shown in the figures and their related reference numerals: apparatus for the filling of containers 1; rotor 2; filling element 3; separation plates 4; filling product reservoir 5; spray nozzle unit 6, 6'; nozzle opening 6*a*; filling pipe 7; protection wall 8; interior space 9; ring line 10; outer area 11; carrier plate 12; controllable valves 13; control unit 14; central control device 15; pressure sensor 16; filling element axis FA; filling position FP; inner side of the filling elements IS; and machine axis MA.

At least one possible exemplary embodiment of the present application relates to an apparatus 1 for the filling of containers with a liquid filling product, comprising a rotor 2 driven such as to rotate about a vertical machine axis MA, with a plurality of filling elements 3 provided and arranged distributed over the circumference of the rotor 2, which are connected to a filling product reservoir 5 provided for the liquid filling product, wherein a plurality of spray nozzle units 6, 6' are provided, which can be subjected to a spray medium and move circulating with the rotor 2, wherein at least one spray nozzle element 6 is permanently assigned to each filling element 3 and rotates with it, and wherein a nozzle opening 6*a* of the spray nozzle units 6, 6' faces towards the respective assigned filling element 3, wherein the spray nozzle units 6, 6' are individually controllable, wherein, for this purpose, the spray nozzle units 6 are equipped with suitable controllable valves 13, and, further, a control unit 14 is provided, which is in communicating connection with the spray nozzle units 6, 6'.

At least one other possible exemplary embodiment of the present application relates to the apparatus 1 for the filling of containers with a liquid filling product, wherein the spray nozzle units 6, 6' are arranged lying radially internally in relation to the machine axis MA and relative to the respective assigned filling elements 3, wherein the nozzle opening 6*a* of each spray nozzle unit 6, 6' faces towards an inner side IS of the assigned filling element 3, pointing in the direction of vertical machine axis MA, and a spray jet emitted by the spray nozzle unit 6,6' is directed away from the vertical machine axis MA outwards and towards the inner side IS of the assigned filling element 3.

At least one other possible exemplary embodiment of the present application relates to the apparatus 1 for the filling of containers with a liquid filling product, wherein each filling element 3 is formed from several filling element components, and comprises at least one filling pipe 7, wherein the at least one spray nozzle unit 6 assigned to the filling element 3 is provided at the rotor 2 in such a way that the nozzle opening 6*a* of the spray nozzle unit 6, 6' is arranged with at least one section of the filling pipe 7 at the same vertical height.

At least one other possible exemplary embodiment of the present application relates to the apparatus 1 for the filling of containers with a liquid filling product, wherein the filling product reservoir 5 is formed by a ring tank arranged at the rotor 2 and rotating with this rotor 2 and carrying the filling elements 3, or that the filling product reservoir 5 is formed by a stationary central container and a pipe ring tank arranged at the rotor 2 and rotating with this rotor, wherein the filling elements 3 are carried at the rotor 2.

At least one other possible exemplary embodiment of the present application relates to the apparatus 1 for the filling of containers with a liquid filling product, wherein in a free interior space 9 of the rotor 2 at least one ring line 10 is provided, secured to an inner side of the rotor and moves with the rotor 2 so as to circulate, for supplying the spray nozzle units 6, 6' with spray medium, wherein the spray nozzle units 6, 6' are connected to the ring line 10 by suitable connection elements.

At least one other possible exemplary embodiment of the present application relates to the apparatus 1 for the filling of containers with a liquid filling product, wherein a protection wall 8 is provided, concentrically surrounding the vertical machine axis MA, which is arranged radially inside the filling elements 3 and delimits the free interior space 9 of the rotor 2 against an outer area 11, wherein the filling elements 3 are arranged in the outer area 11.

At least one other possible exemplary embodiment of the present application relates to the apparatus 1 for the filling of containers with a liquid filling product, wherein the spray nozzle units 6, 6' are provided in the area of the protection wall 8, wherein the nozzle openings 6*a* of the spray nozzle units 6, 6' are arranged on an outer side of the protection wall 8 facing towards the outer area 11.

At least one other possible exemplary embodiment of the present application relates to the apparatus 1 for the filling of containers with a liquid filling product, wherein a respective nozzle body of the spray nozzle units 6, 6' is received in corresponding cut-out openings provided in the protection wall 8, and project through the protection wall 8, wherein the nozzle body extends at least from an inner side of the protection wall 8 facing towards the interior space 9 as far as into the outer area 11.

At least one other possible exemplary embodiment of the present application relates to the apparatus 1 for the filling of containers with a liquid filling product, wherein two or more spray nozzle units 6, 6' are permanently assigned to each filling element 3, wherein the spray nozzle units 6, 6' assigned to a respective filling element 3 can be controlled individually and/or together in predetermined groups.

At least one other possible exemplary embodiment of the present application relates to the apparatus 1 for the filling of containers with a liquid filling product, wherein the controllable valve 13 is a pneumatically controlled media valve.

At least one other possible exemplary embodiment of the present application relates to the apparatus 1 for the filling of containers with a liquid filling product, wherein each filling element 3 is equipped with a pressure sensor 16 for the measurement of the pressure prevailing in the container, wherein the pressure sensor 16 is in communicating connection with the control unit 14.

At least one other possible exemplary embodiment of the present application relates to the apparatus 1 for the filling of containers with a liquid filling product, wherein, in addition to the spray nozzle units 6, 6' arranged radially inside the filling elements 3, further spray nozzle units, which are arranged radially outside the filling elements 3 and of which the spray jet is directed inwards in the direction onto the vertical machine axis MA.

At least one possible exemplary embodiment of the present application relates to a method for filling containers with a liquid filling product using an apparatus for filling containers, wherein the apparatus comprises a rotor 2 which can be driven such as to rotate about a vertical machine axis MA, with a plurality of filling elements 3 arranged distributed over the circumference of the rotor 2, which are connected to a filling product reservoir 5 provided for the liquid filling product, wherein, with the apparatus, permanently assigned to each filling element 3 is at least one controllable spray nozzle unit 6 which can be subjected to a spray medium and moves with the rotor 2 in a circulating manner, wherein, with the method, if the need arises, a spray procedure can be initiated and carried out for spraying at least one section of at least one specific filling element 3, wherein, for this purpose, at least the at least one spray nozzle unit 6 assigned to this filling element 3 is individually actuated by a control unit 14 provided, wherein a controllable valve 13 of the spray nozzle unit 6 is opened and a spray jet emitted by the spray nozzle unit 6 is directed onto at least one section of the filling element 3.

At least one other possible exemplary embodiment of the present application relates to the method for filling containers with a liquid filling product using an apparatus for filling containers, wherein a spray procedure for the spraying of at least one section of at least one specific filling element 3 is initiated and carried out as a reaction to a glass breakage incident at a corresponding filling position FP, wherein, by a pressure sensor 16 provided at the filling element 3 for the measuring of a container internal pressure, a sudden pressure drop occurring with the glass breakage incident is measured, and whereby, as a dependency of corresponding measurement date and evaluation data of such a measured pressure drop, by the control unit 14 at least the spray nozzle unit 6 assigned to the filling element 3 at the corresponding filling position FP is actuated, in order to initiate a spraying procedure.

At least one other possible exemplary embodiment of the present application relates to the method for filling containers with a liquid filling product using an apparatus for filling containers, wherein, as a reaction to a glass breakage incident at a corresponding filling position FP a plurality of spray nozzle units 6 are actuated, in order to initiate a spraying procedure at several of the filling positions FP upstream and/or downstream of the corresponding filling position FP.

At least one possible exemplary embodiment of the present application relates to a container filling arrangement for filling beverage bottles or similar containers with a liquid beverage or similar liquid filling material, the container filling arrangement comprising: a rotor being rotatable about a vertical machine axis; a reservoir being configured and disposed to store a supply of liquid beverage or similar liquid filling material; filling devices being disposed about the circumference of said rotor; said filling devices being operatively connected to said reservoir to permit dispensing of liquid filling material by said filling devices; spray nozzle units being configured and disposed to spray said filling devices in a filling device treatment; each of said spray nozzle units being mounted adjacent and to rotate with a corresponding filling device; each of said spray nozzle units comprising a nozzle opening being disposed to face towards its corresponding filling device; said spray nozzle units comprising valves configured to be opened and closed to start and stop spraying of said filling devices; and a control arrangement being operatively connected to said valves to individually control the opening and closing of said valves.

At least one other possible exemplary embodiment of the present application relates to the container filling arrangement, wherein: said filling arrangement comprises a vertical machine axis about which said rotor is disposed to rotate; said spray nozzle units are disposed closer to said vertical machine axis, along a substantially radial direction with respect to said vertical machine axis, than their corresponding filling devices; said nozzle openings are disposed to face away from said vertical machine axis and toward an inner portion of each of their corresponding filling devices to permit said spray nozzle units to emit a spray jet toward said inner portions.

At least one other possible exemplary embodiment of the present application relates to the container filling arrangement, wherein: each of said filling devices comprises at least one filling pipe; said spray nozzle units comprise filling pipe spray nozzle units configured and disposed to spray their corresponding filling pipes; and each of said nozzle openings of said filling pipe spray nozzle units is disposed at a vertical position with respect to the horizontal having a similar height as a vertical position of its corresponding filling pipe.

At least one other possible exemplary embodiment of the present application relates to the container filling arrangement, wherein said reservoir comprises one of (A) or (B): (A) a ring tank disposed at said rotor and configured to rotate with said rotor, wherein said filling elements are connected to and supported by said ring tank; or (B) a stationary central container; and a pipe ring tank operatively connected to said stationary central container, wherein said pipe ring tank is disposed at said rotor and configured to rotate with said rotor, and wherein said filling elements are connected to and supported by said ring tank.

At least one other possible exemplary embodiment of the present application relates to the container filling arrangement, wherein: the container filling arrangement further comprises at least one ring line disposed in an interior space within said rotor; said at least one ring line is attached to an inner side of said rotor and is configured and disposed to rotate with said rotor; and said at least one ring line is operatively connected to said spray nozzle units to supply said spray nozzle units with a spray medium.

At least one other possible exemplary embodiment of the present application relates to the container filling arrangement, wherein: the container filling arrangement further comprises a wall disposed to concentrically surround said vertical machine axis and said interior space of said rotor; and said wall is disposed closer to said vertical machine axis, along a substantially radial direction, than said filling devices, such that said filling devices are disposed in an outer area outside of said interior space.

At least one other possible exemplary embodiment of the present application relates to the container filling arrangement, wherein said spray nozzle units are disposed at or on said wall such that said nozzle openings are disposed on an outer side of said wall facing towards said outer area.

At least one other possible exemplary embodiment of the present application relates to the container filling arrangement, wherein each of said spray nozzle units comprises a spray nozzle unit body that is either: mounted completely on the outer side of said wall; or mounted in said wall, such that an inner portion of said spray nozzle unit body is disposed in said interior space within said wall and an outer portion of said spray nozzle unit body is disposed in said outer area outside of said wall.

At least one other possible exemplary embodiment of the present application relates to the container filling arrangement, wherein: said spray nozzle units comprise spray nozzle unit groups comprising at least two spray nozzle units; each of said spray nozzle unit groups is disposed at and configured to spray one corresponding filling device; and each of said spray nozzle units in said spray nozzle unit groups comprise one of: an individually-controlled spray nozzle unit configured to be activated at different times or at the same time; and a group-controlled spray nozzle unit configured to be activated only at the same time as all other spray nozzle units in said spray nozzle group.

At least one other possible exemplary embodiment of the present application relates to the container filling arrangement, wherein said valves comprise pneumatically-controlled valves.

At least one other possible exemplary embodiment of the present application relates to the container filling arrangement, wherein: each of said filling devices comprises a pressure sensor; said pressure sensors are configured and disposed to measure pressure in containers handled by said filling devices; and said pressure sensors are operatively connected to said control arrangement.

At least one other possible exemplary embodiment of the present application relates to the container filling arrangement, wherein the container filling arrangement comprises additional spray nozzle units disposed outside of said filling devices and configured to spray inwardly toward said vertical machine axis.

At least one other possible exemplary embodiment of the present application relates to the container filling arrangement, wherein: each of said filling devices comprises a pressure sensor; said pressure sensors are configured and disposed to measure pressure in containers handled by said filling devices; and said pressure sensors are operatively connected to said control arrangement.

At least one other possible exemplary embodiment of the present application relates to the container filling arrangement, wherein: said pressure sensors are operatively connected to said control arrangement; said control arrangement is configured, upon detection of a sudden drop in pressure from an expected pressure inside a glass beverage bottle or similar container corresponding to a breakage of the glass beverage bottle or similar container, to determine a contaminated condition of said corresponding filling device, in which said corresponding filling device is contaminated by at least one of: glass splinters, glass shards, and liquid beverage or similar liquid filling material; and said control arrangement is configured to individually activate at least one spray nozzle unit disposed at said contaminated filling device to spray said contaminated filling device with spray medium to remove at least one of: glass splinters, glass shards, and liquid beverage or similar liquid filling material from said contaminated filling device.

At least one other possible exemplary embodiment of the present application relates to the container filling arrangement, wherein the container filling arrangement comprises separation plates disposed between adjacent filling devices to minimize contamination of filling devices by glass shards or splinters generated by a breakage of a glass beverage bottle or similar container at an adjacent filling device.

At least one other possible exemplary embodiment of the present application relates to the container filling arrangement, wherein the container filling arrangement comprises separation plates disposed between adjacent filling devices to minimize contamination of filling devices by glass shards or splinters generated by a breakage of a glass beverage bottle or similar container at an adjacent filling device.

At least one possible exemplary embodiment of the present application relates to a method of filling beverage bottles or similar containers with a liquid beverage or similar liquid filling material using a container filling arrangement comprising: a rotor being rotatable about a vertical machine axis; a reservoir to store a supply of liquid beverage or similar liquid filling material; filling devices disposed about the circumference of said rotor and operatively connected to said reservoir to permit dispensing of liquid filling material by said filling devices; spray nozzle units mounted at and to rotate with a corresponding filling device; said method comprising the steps of: filling beverage bottles or similar containers with a liquid beverage or similar liquid filling material while said filling devices are rotated by said rotor; and upon one of said filling devices being in a contaminated condition: individually activating at least one spray nozzle unit disposed at said contaminated filling device by opening a controllable valve of said at least one spray nozzle unit; emitting a spray jet directed onto at least one section of said contaminated filling device; and continuing spraying said contaminated filling device until the contaminated condition is treated.

At least one other possible exemplary embodiment of the present application relates to the method, wherein said method further comprises detecting, using a control arrangement, a contaminated condition of one of said filling devices.

At least one other possible exemplary embodiment of the present application relates to the method, wherein said step of detecting comprises: monitoring and measuring, using a pressure sensor disposed at a corresponding filling device, the pressure inside a glass beverage bottle or similar container being handled by said corresponding filling device; detecting a sudden drop in pressure from an expected pressure inside a glass beverage bottle or similar container corresponding to a breakage of the glass beverage bottle or similar container; and determining, based on said sudden drop in pressure, a contaminated condition of said corresponding filling device in which said corresponding filling device is contaminated by at least one of: glass splinters, glass shards, and liquid beverage or similar liquid filling material.

At least one other possible exemplary embodiment of the present application relates to the method, wherein said method further comprises spraying at least one other filling device disposed adjacent said contaminated filling device, which said at least one other filling device is potentially contaminated by the breakage of the glass beverage bottle or similar container at said contaminated filling device.

Any numerical values disclosed herein, if any, should be understood as disclosing all approximate values within plus or minus ten percent of the numerical value. Any ranges of numerical values disclosed herein, if any, should be understood as disclosing all individual values within the range of values, including whole numbers, tenths of numbers, or hundredths of numbers.

The entirety of the appended drawings, including all dimensions, proportions, and/or shapes disclosed thereby or reasonably understood therefrom, are hereby incorporated by reference.

All of the patents, patent applications, patent publications, and other documents cited herein, are hereby incorporated by reference as if set forth in their entirety herein.

The corresponding foreign or international patent applications, as originally filed and as published, from which the present application claims the benefit of priority, are hereby incorporated by reference as if set forth in their entirety herein, as follows: PCT/DE2020/100215; WO2020211895; and DE102019110012.7.

The following patents, patent applications, patent publications, and other documents cited in the corresponding foreign or international patent applications listed in the preceding paragraph are hereby incorporated by reference as if set forth in their entirety herein, as follows: DE102014103504A1; EP0615947A1; DE2739742A1; DE102011008878A1; and DE4331745.

Although the invention has been described in detail for the purpose of illustration of any embodiments disclosed herein, including the most practical or preferred embodiments at the time of filing of this application, it is to be understood that such detail is solely for that purpose and that the invention is not limited to such embodiments, but, on the contrary, is intended to cover modifications and equivalent arrangements that are within the spirit and scope of the present application, including the specification and the claims as originally filed, as amended, or as issued. For example, it is to be understood that the present invention contemplates that, to the extent possible, one or more features or components of any disclosed embodiment can be combined with one or more features or components of any other disclosed embodiment.

What is claimed is:

1. A container filling arrangement for filling beverage bottles or similar containers with a liquid beverage or similar liquid filling material, the container filling arrangement comprising:

a rotor being rotatable about a vertical machine axis;

a reservoir being configured and disposed to store a supply of liquid beverage or similar liquid filling material;

filling devices being disposed about the circumference of said rotor;

said filling devices being operatively connected to said reservoir to permit dispensing of liquid filling material by said filling devices;

spray nozzle units being configured and disposed to spray said filling devices in a filling device treatment, wherein each of said filling devices may be sprayed independently of a rotary position of said rotor;

each of said spray nozzle units being mounted adjacent a corresponding filling device and to rotate with the corresponding filling device;

each of said spray nozzle units comprising a nozzle opening being disposed to face towards its corresponding filling device;

said spray nozzle units comprising valves configured to be opened and closed to start and stop spraying of said filling devices; and an electronic control unit operatively connected to said valves to individually control the opening and closing of said valves to selectively activate said nozzles individually, in a plurality, or in specific groups.

2. The container filling arrangement according to claim 1, wherein the container filling arrangement comprises separation plates disposed between adjacent filling devices to minimize contamination of filling devices by glass shards or splinters generated by a breakage of a glass beverage bottle or similar container at an adjacent filling device.

3. The container filling arrangement according to claim 1, wherein: each of said filling devices comprises a pressure sensor;

said pressure sensors are configured and disposed to measure pressure in containers handled by said filling devices; and said pressure sensors are operatively connected to said control arrangement.

4. The container filling arrangement according to claim 3, wherein:

said pressure sensors are operatively connected to said control arrangement;

said control arrangement is configured, upon detection of a sudden drop in pressure from an expected pressure inside a glass beverage bottle or similar container corresponding to a breakage of the glass beverage bottle or similar container, to determine a contaminated condition of said corresponding filling device, in which said corresponding filling device is contaminated by at least one of:

glass splinters, glass shards, and liquid beverage or similar liquid filling material; and said control arrangement is configured to individually activate at least one spray nozzle unit disposed at said contaminated filling device to spray said contaminated filling device with spray medium to remove at least one of:

glass splinters, glass shards, and liquid beverage or similar liquid filling material from said contaminated filling device.

5. The container filling arrangement according to claim 4, wherein the container filling arrangement comprises separation plates disposed between adjacent filling devices to minimize contamination of filling devices by glass shards or splinters generated by a breakage of a glass beverage bottle or similar container at an adjacent filling device.

6. The container filling arrangement according to claim 1, wherein:

said filling arrangement comprises a vertical machine axis about which said rotor is disposed to rotate;

said spray nozzle units are disposed closer to said vertical machine axis, along a substantially radial direction with respect to said vertical machine axis, than their corresponding filling devices;

said nozzle openings are disposed to face away from said vertical machine axis and toward an inner portion of each of their corresponding filling devices to permit said spray nozzle units to emit a spray jet toward said inner portions.

7. The container filling arrangement according to claim 6, wherein:

each of said filling devices comprises at least one filling pipe;

said spray nozzle units comprise filling pipe spray nozzle units configured and disposed to spray their corresponding filling pipes; and each of said nozzle openings of said filling pipe spray nozzle units is disposed at a vertical position with respect to the horizontal having a similar height as a vertical position of its corresponding filling pipe.

8. The container filling arrangement according to claim 7, wherein said reservoir comprises one of (A) or (B):

(A) a ring tank disposed at said rotor and configured to rotate with said rotor, wherein said filling elements are connected to and supported by said ring tank; or (B) a stationary central container; and a pipe ring tank operatively connected to said stationary central container, wherein said pipe ring tank is disposed at said rotor and configured to rotate with said rotor, and wherein said filling elements are connected to and supported by said ring tank.

9. The container filling arrangement according to claim 8, wherein:

the container filling arrangement further comprises at least one ring line disposed in an interior space within said rotor;

said at least one ring line is attached to an inner side of said rotor and is configured and disposed to rotate with said rotor; and said at least one ring line is operatively connected to said spray nozzle units to supply said spray nozzle units with a spray medium.

10. The container filling arrangement according to claim 9, wherein:

the container filling arrangement further comprises a well disposed to concentrically surround said vertical machine axis and said interior space of said rotor; and said wall is disposed closer to said vertical machine axis, along a substantially radial direction, than said filling devices, such that said filling devices are disposed in an outer area outside of said interior space.

11. The container filling arrangement according to claim 10, wherein said spray nozzle units are disposed at or on said wall such that said nozzle openings are disposed on an outer side of said wall facing towards said outer area.

12. The container filling arrangement according to claim 11, wherein each of said spray nozzle units comprises a spray nozzle unit body that is either:

mounted completely on the other side of said wall; or mounted in said wall, such that an inner portion of said spray nozzle unit body is disposed in said interior space within said wall and an outer portion of said spray nozzle unit body is disposed in said outer area outside of said wall.

13. The container filling arrangement according to claim 12, wherein:

said spray nozzle units comprise spray nozzle unit groups comprising at least two spray nozzle units;

each of said spray nozzle unit groups is disposed at and configured to spray one corresponding filling device; and each of said spray nozzle units in said spray nozzle unit groups comprise one of:

an individually-controlled spray nozzle unit configured to be activated at different times or at the same time; and a group-controlled spray nozzle unit configured to be activated only at the same time as all other spray nozzle units in said spray nozzle group.

14. The container filling arrangement according to claim 13, wherein said valves comprise pneumatically-controlled valves.

15. The container filling arrangement according to claim 14, wherein: each of said filling devices comprises a pressure sensor;

said pressure sensors are configured and disposed to measure pressure in containers handled by said filling devices; and said pressure sensors are operatively connected to said control arrangement.

16. The container filling arrangement according to claim 15, wherein the container filling arrangement comprises additional spray nozzle units disposed outside of said filling devices and configured to spray inwardly toward said vertical machine axis.

17. A method of filling beverage bottles or similar containers with a liquid beverage or similar liquid filling material using a container filling arrangement comprising:

a rotor being rotatable about a vertical machine axis;

a reservoir to store a supply of liquid beverage or similar liquid filling material;

filling devices disposed about the circumference of said rotor and operatively connected to said reservoir to permit dispensing of liquid filling material by said filling devices;

spray nozzle units mounted at and to rotate with a corresponding filling device;

said method comprising the steps of:

filling beverage bottles or similar containers with a liquid beverage or similar liquid filling material while said filling devices are rotated by said rotor; and upon one of said filling devices being in a contaminated condition:

individually activating by an electronic control unit at least one spray nozzle unit disposed at said contaminated filling device by opening a controllable valve of said at least one spray nozzle unit, wherein the at least one spray nozzle is activated to spray said contaminated filling device independently of a rotary position of said rotor;

emitting a spray jet directed onto at least one section of said contaminated filling device; and continuing spraying said contaminated filling device until the contaminated condition is treated.

18. The method according to claim 17, wherein said method further comprises detecting, using a control arrangement, a contaminated condition of one of said filling devices.

19. The method according to claim 18, wherein said step of detecting comprises:

monitoring and measuring, using a pressure sensor disposed at a corresponding filling device, the pressure inside a glass beverage bottle or similar container being handled by said corresponding filling device;

detecting a sudden drop in pressure from an expected pressure inside a glass beverage bottle or similar container corresponding to a breakage of the glass beverage bottle or similar container; and determining, based on said sudden drop in pressure, a contaminated condition of said corresponding filling device in which said corresponding filling device is contaminated by at least one of:

glass splinters, glass shards, and liquid beverage or similar liquid filling material.

20. The method according to claim 19, wherein said method further comprises spraying at least one other filling device disposed adjacent said contaminated filling device, which said at least one other filling device is potentially contaminated by the breakage of the glass beverage bottle or similar container at said contaminated filling device.

* * * * *